US005377874A

United States Patent [19]

Brown

[11] Patent Number: 5,377,874

[45] Date of Patent: Jan. 3, 1995

[54] SINGLE PORTION LIQUID DISPENSER

[75] Inventor: Donald W. Brown, Pawtucket, R.I.

[73] Assignee: John G. Brown, North Providence, R.I.

[21] Appl. No.: 232,659

[22] Filed: Apr. 25, 1994

Related U.S. Application Data

[63] Continuation-in-part of Ser. No. 91,859, Jul. 14, 1993, Pat. No. 5,330,075.

[51] Int. Cl.[6] ..... B67D 5/00

[52] U.S. Cl. ..... 222/82; 222/83; 222/106; 222/192; 401/132; 206/229; 604/3

[58] Field of Search ..... 222/82, 83, 83.5, 106, 222/192, 386, 541; 30/366, 136; 401/132; 206/229; 604/1, 2, 3, 289, 904

[56] References Cited

U.S. PATENT DOCUMENTS

| | | | |
|---|---|---|---|
| 2,361,647 | 10/1944 | Nyden | 221/60 |
| 2,684,791 | 7/1954 | Sebell | 222/386 |
| 2,695,735 | 11/1954 | Van Doornik | 222/386 |
| 2,880,913 | 4/1959 | Peyron | 222/214 |
| 3,464,592 | 9/1969 | Stroop | 222/82 |
| 3,521,795 | 7/1970 | Langhjelm et al. | 222/386 |
| 3,730,336 | 5/1973 | Feldman | 206/47 B |
| 4,637,934 | 1/1987 | White | 426/117 |
| 4,747,719 | 5/1988 | Parkin | 604/1 |
| 4,854,760 | 8/1989 | Pike et al. | 401/134 |
| 5,137,177 | 8/1992 | Willis | 222/1 |
| 5,152,742 | 10/1992 | Simpson | 604/3 |
| 5,330,075 | 7/1994 | Brown, Sr. | 222/82 |

FOREIGN PATENT DOCUMENTS

| | | | |
|---|---|---|---|
| 463979A | 1/1992 | European Pat. Off. | 222/106 |
| 8910156 | 11/1989 | WIPO | 604/3 |

*Primary Examiner*—Gregory L. Huson
*Attorney, Agent, or Firm*—Barlow & Barlow, Ltd.

[57] ABSTRACT

A liquid dispenser is provided for dispensing fluid condiment materials, such as ketchup, mustard and mayonnaise as well as other liquids such as medicated salves, lotions and ointments. The dispenser includes a tubular body with a spherical plunger element connected to a spreader paddle member disposed within a tubular body. Upon external manipulation of the tubular body, the spherical plunger and spreader paddle arrangement is urged toward a dispenser nozzle for release of condiment filling contained therein. The sanitary spreader paddle simultaneously protrudes from within the tubular body as condiment filling is being evacuated. As a result, the user may evacuate the entire volume of condiment filling within the dispenser as well as spread the deposited condiment filling on a food article to be eaten. In a medical application of the invention, the dispenser includes an integral applicator swab which is connected to the spreader paddle and resides within the plunger. The spreader paddle is separated from the plunger to expose the cleansing swab for use on the body.

17 Claims, 5 Drawing Sheets

SINGLE PORTION LIQUID DISPENSER

This application is a continuation-in-part of U.S. patent application Ser. No. 08/091,859 filed Jul. 14, 1993, now U.S. Pat. No. 5,330,075.

BACKGROUND OF THE INVENTION

The present invention relates generally to a liquid dispenser device. More specifically, the present invention relates to a single portion liquid dispenser for dispensing condiments such as ketchup, mustard, and the like as well a salve lotions and ointments for medical or hygiene purposes.

There have been many attempts in the general dispenser art to provide an apparatus capable of evacuating the entire volume of material contained in the dispensing tube. For example, U.S. Pat. No. 3,521,795 issued to Langhjelm et al teaches a full discharge dispensing container having a plunger element to assist in urging the material out of the tube. Langhjelm et al employs various types of nozzles to assist in the dispensing of pastes, such as toothpaste. U.S. Pat. No. 5,137,177 issued to Willis discloses a dispensing tube employing a spherical plunger ball and a tube with circumferential ridges for incremented movement of the plunger ball. Both of these prior an devices are designed for pastes and creams, such as toothpaste. Each require complex nozzle arrangements, particularly Langhjelm et al, and provide no means for spreading the material once dispensed.

In the food industry, particularly the fast food industry, it has been well known to employ a tube-like plastic member for housing condiment items such as ketchup, mustard and mayonnaise. Typically, prior art condiment dispensers include a tubular member for housing the food condiment which is subsequently crimped at the tube's two opposing ends employing known methods. Upon use, one of the crimped ends of the tubular package is severed permitting the food condiment to exit. The user must squeeze the package to urge the food condiment out of the package and onto the food article, such as a hamburger, to be eaten. To insure that the entire volume of the food condiment is evacuated from the tube, the user often pinches the tube and slides his fingers along the length of the robe to urge the condiment out of the tube. Many times, two hands are required to accomplish this; one hand holds the tube while the other hand slides along the length of the tube to urge the material out. Such action requires the food article to be placed on a table, the user's lap, or the like, so the food condiment can be applied thereon. However, many instances arise where the food condiment must be applied with one hand while the other hand holds the food article. In such a situation, the food condiment is dispensed in an inefficient and uncleanly manner. Moreover, in this situation, it is unlikely that the entire volume of food condiment will be urged out of the tube. As a result, a tremendous amount of food condiment is wasted and thrown away.

Prior art food condiment dispensers, which are readily available at fast food restaurants, are extremely unsanitary. Even though the food condiment is packaged in a sanitary and air-tight manner, the method of dispensing and applying the food condiment to the food article destroys the sanitary state of the food condiment. With a prior art condiment dispenser, the food condiment may be applied to any desired location in any configuration by the user. However, it is often necessary for the user to spread the food condiment on the surface of the food article to obtain a preferred even coating of the food condiment on the food article. To accomplish this, the food condiment tube dispenser itself is often used to spread the food condiment evenly on the food article. Such a use is unsanitary due to the likelihood that the outer surface of the dispenser is dirty due to handling by employees and storage in uncleanly containers.

Similarly, in the medical field, it has been well known to employ a tube-like plastic member for housing salves, lotions, ointments, and the like. These tubes are typically crimped or sealed employing known methods. These known packages for medical and hygiene related liquids suffer from the same shortcomings found in prior art food condiment dispensers. For example, it is difficult to evacuate all the liquid from the package and dispersing is inefficient and unsanitary.

Due to the present day concerns over transmitted diseases, for example, AIDS, the sanitary application of liquid and proper disposal thereof has become extremely important. Today, it is common for a physician or nurse to apply, for example, a medicated liquid from a small package to a patient's wound which has exposed blood. Typically, the physician would apply the liquid to the affected area, and then spread the liquid with the same package which contained the medicated liquid. Such use of the package for spreading is unsanitary and promotes infection. Further, these exposed packages are often not disposed of properly to avoid contamination and exposure to others.

As a result, prior art liquid dispensers are inadequate for providing a completely sanitary liquid dispenser which is capable of dispensing and spreading the entire volume of the liquid contained therein.

SUMMARY OF THE INVENTION

The present invention preserves the advantages of prior art liquid dispensers. In addition, it provides new advantages not found in currently available liquid dispensers, and overcomes many of the disadvantages of such currently available dispensers.

The invention is generally directed to a novel and unique liquid dispenser with particular application in dispensing a single portion of food condiment to a food article and dispensing medical salves, lotions and ointments. The single portion food condiment dispenser of the present invention provides the simple, clean and easy dispensing of a food condiment, such as ketchup, mustard or mayonnaise, onto a food article, such as a hamburger or hot dog as well as dispensing medicated liquids onto a wound. Single hand dispensing and spreading can also be achieved by the present invention.

The preferred embodiment of the present invention includes an elongated flexible tubular body with two opposing ends. A first end is completely closed while a second end serves as a dispensing nozzle for the dispenser. A spherical plunger element is disposed completely within the tubular body and is positioned adjacent the completely closed end of the elongated flexible tubular body. Connected to the spherical plunger element is an elongated spreader paddle which preferably has a pointed tip end. The pointed tip end of the spreader paddle resides in a recess in the second end of the tubular body. As a result, the spreader paddle is supported and centered within the tubular body so as to remain coaxial and parallel with the longitudinal axis of the tubular body. When the spherical plunger is moved toward the second end of the tubular body due to external manipulation of the tubular body, the food condiment is urged toward the second end of the tubular body while the pointed tip end of the spreader paddle penetrates through the second end of the tubular body. The food condiment provides lubrication for easy sliding of the spherical plunger. As a result, the food condiment exits out of the dispensing nozzle while, simultaneously, the spreader paddle protrudes out through as well.

In operation, the user would externally manipulate the tubular body which contains a single portion of food condiment. Ideally, the spherical plunger element would be seated within the tubular body adjacent to the internal wall of its first end. The volume of the tubular body between the spherical plunger element and the dispensing nozzle would be filled with food condiment. As the plunger ball is moved toward the dispensing nozzle, the sharpened tip of the spreader paddle would pierce through the second end of the tubular body permitting the release of condiment therefrom. As the spherical plunger element is further moved, more condiment is urged out of the tubular body. Simultaneously, a greater length of the spreader paddle will protrude through the dispenser nozzle. After the food condiment is evacuated from within the tubular body, or any particular desired volume and applied onto a food article to be eaten, a length of the spreader paddle is now available for sanitary spreading of the food condiment present on the food article. With the present invention, simultaneous spreading and food condiment application can be achieved.

In an alternative embodiment of the present invention, the structure employed for food condiment may alternatively be used for dispensing other liquids such as medicated lotions, salves and ointments for application to the body. In this alternative embodiment, the elongated spreader paddle is separable from the plunger element and carries a sanitary swab or sponge on the end which is not pointed. The swab end of the spreader paddle is seated within a recess within the plunger element during storage and while urging liquid from the dispenser. When needed, the spreader paddle is separated from the plunger and removed from the dispenser to expose the swab end for use on a wound or the like.

It is therefore an object of the present invention to provide a liquid dispenser that may achieve full discharge of the fluid material therein.

Another object of the present invention is to provide a food condiment dispenser capable of single hand dispensing and application of the fluid material contained therein.

It is a further object of the present invention to provide a liquid dispenser capable of sanitary spreading of the liquid.

It is yet a further object of the present invention to provide a food condiment dispenser that provides simultaneous application and spreading of a food condiment onto a food article to be eaten.

It is another object of the present invention to provide a liquid dispenser that provides sanitary application of the liquid with the assistance of a sanitary applicator swab incorporated into the dispenser.

BRIEF DESCRIPTION OF THE DRAWINGS

The novel features which are characteristic of the present invention are set forth in the appended claims, However, the invention's preferred embodiments, together with further objects is and attendant advantages, will be best understood by reference to the following detailed description taken in connection with the accompanying drawings in which:

FIG. 12 is a side view of the dispenser of FIG. 8 with swab reinserted and dispenser sealed for disposal.

DETAILED DESCRIPTION OF THE PREFERRED EMBODIMENT

Figure 1:
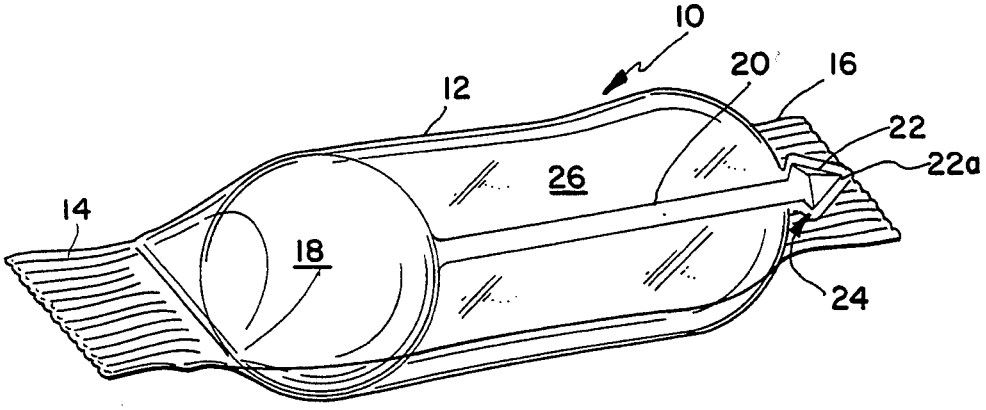
FIG. 1 is a perspective view of a food condiment dispenser of the present invention.
Figure 2:
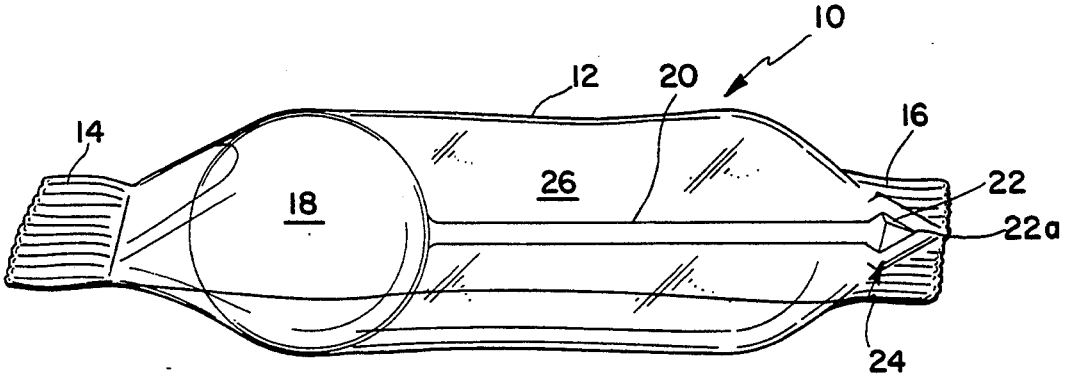
FIG. 2 is a side view of the food condiment dispenser of the present invention.

Referring to FIGS. 1 and 2, a food condiment dispenser 10 is generally shown to include a flexible tubular body 12 crimped at opposing ends 14 and 16. Disposed completely within tubular body 12 is a preferably spherical plunger element 18. A spreader paddle 20 is an elongated member having one end connected to spherical plunger element 18 and the other end 22 being free. As shown in FIG. 1, free end 22 of spreader paddle 20 preferably has a pointed tip **22*a*. Free end 22 of spreader paddle 20 may reside in recess 24 in crimped tubular body end 16. As more clearly shown in FIG. 2, the free end 22 of spreader paddle 20 resides in recess 24 to provide support and centering of the spreader paddle within tubular body 12**. While it is preferred to have such a recess, other means may be employed to achieve such centering and support. Alternatively, the invention may be manufactured without such centering and support means which may degrade the performance of the dispenser.

Figure 3:
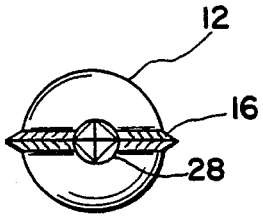
FIG. 3 is a side end view of the dispenser nozzle end of the present invention.

Turning now to FIG. 3, dispenser nozzle 28 formed in crimped tubular body end 16 can clearly be seen. Dispenser nozzle 28 may be a portion of crimped tubular body end 16 or may be an additional member affixed to body end 16 having an easily penetrable membrane for piercing by the pointed tip **22*a* on free end 22 of spreader paddle 20. However, it is preferred to employ the existing crimped tubular body end 16 of tubular body 12 as the dispenser nozzle for the present invention. Such an embodiment of the tubular body 12 would enable one to employ a tubular body that is known in the prior art without significant modification. Notwithstanding this, the tubular body 12 must be capable of being pierced by the free end 22 of spreader paddle 20 to create dispenser nozzle 28**.

Referring back to FIGS. 1 and 2, spherical plunger element 18 is disposed within tubular body 12 adjacent to crimped tubular body end 14. Condiment filling 26 fills the internal volume of tubular body 12 between spherical plunger element 18 and crimped tubular body end 16. Such a structure enables a maximum volume of condiment filling 26 to be contained within tubular body 12.

Figures 4A, 4B, 4C:
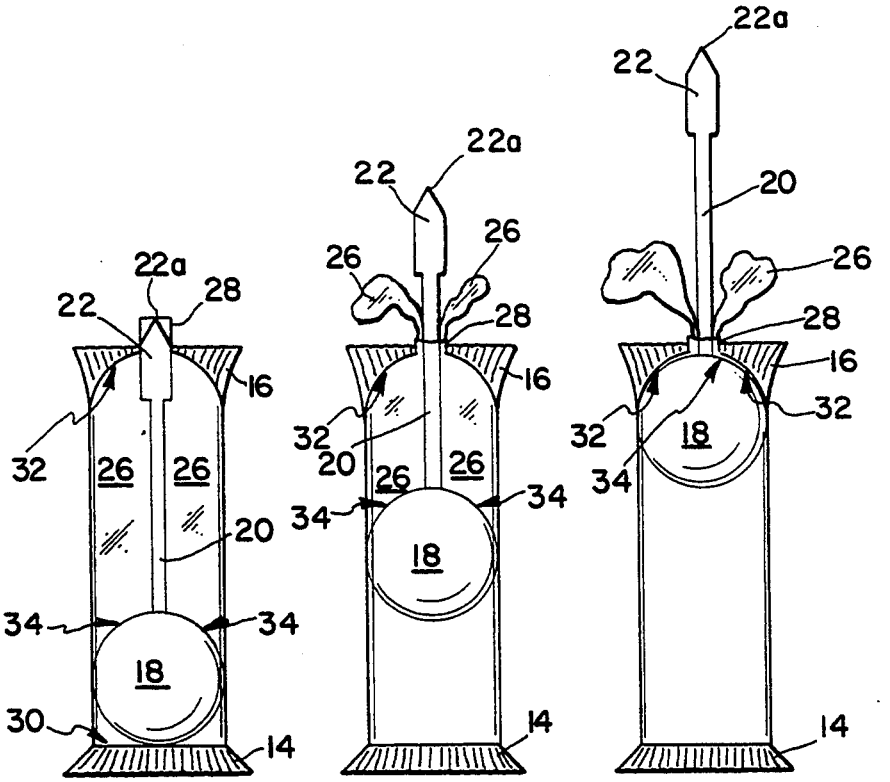
FIGS. 4A–4C are various stages of use of the preferred embodiment of the present invention.

FIGS. 4A–4C show various stages of use of the condiment dispenser of the present invention. Referring first to FIG. 4A, it can be seen that the food condiment dispenser of the present invention is in a stored or non-dispensing state. Spherical plunger element 18 is completely retracted and abutted against bottom inner wall 30 which is adjacent to crimped tubular body end 14. A full volume or portion of condiment filling 26 resides in the cavity of the tubular body 12 between top surface 34 of spherical plunger element 18 and top inner wall 32. In FIG. 4A, free end 22 of spreader paddle 20 resides within dispenser nozzle 28 in preparation for piercing through.

Turning now to FIG. 4B, spherical plunger element 18 is moved towards top inner wall 32 by external manipulation of tubular body 12. As a result, the volume of the cavity bounded by top inner wall 32 and top surface 34 of spherical plunger element 18 thereby decreases simultaneously urging pointed tip **22*a* on free end 22 through dispenser nozzle 28 into the environment. The condiment filling 26 provides lubrication to assist the urging of spherical plunger element 18. Further, condiment filling 26 exits dispenser nozzle 28 for application onto a food article, such as s a hamburger or hot dog to be eaten (not shown). As shown in FIG. 4C, spherical plunger element 18 may be moved until top surface 34 to the plunger element abuts against the top inner wall 32 thereby evacuating the entire volume of condiment filling 26 contained within tubular body 12. Condiment filling 26, as shown in FIG. 4C**, may be applied as desired to a food article.

It can be seen in FIGS. 4B and 4C that urging spherical plunger element 18 toward dispenser nozzle 28 not only urges condiment filling to exit dispenser nozzle 28, but simultaneously causes spreader paddle 20 to protrude outside the tubular body 12. The further the spherical plunger element 18 is urged upward, the further spreader paddle 20 protrudes outside the tubular body 12. The movement of spreader paddle 20 not only pierces dispenser nozzle 28 to permit the release of condiment filling 26, but also provides the capability of simultaneous spreading of condiment 26 on a food article. Alternatively, the entire volume of condiment filling 26 can be evacuated from tubular body 12 and, thereafter, the user can utilize spreader paddle 20 to spread evacuated condiment filling 26 in a knife-like fashion on the food article.

The employment of a spreader paddle in conjunction with a spherical plunger element overcomes many disadvantages and problems found in the prior art. As can be seen in FIGS. 4A–4C, the entire volume of condiment filling 26 can be evacuated from tubular body 12. Further, the use of a possible unsanitary member as a spreader can be completely avoided by employment of the present invention. Moreover, the unique spreader paddle 20 of the present invention is a sanitary and clean member which has had no contact with any materials or environment other than the condiment filling 26 itself. Therefore, sanitary spreading can be achieved cleanly and efficiently with the present invention.

Figures 5A, 5B, 5C:
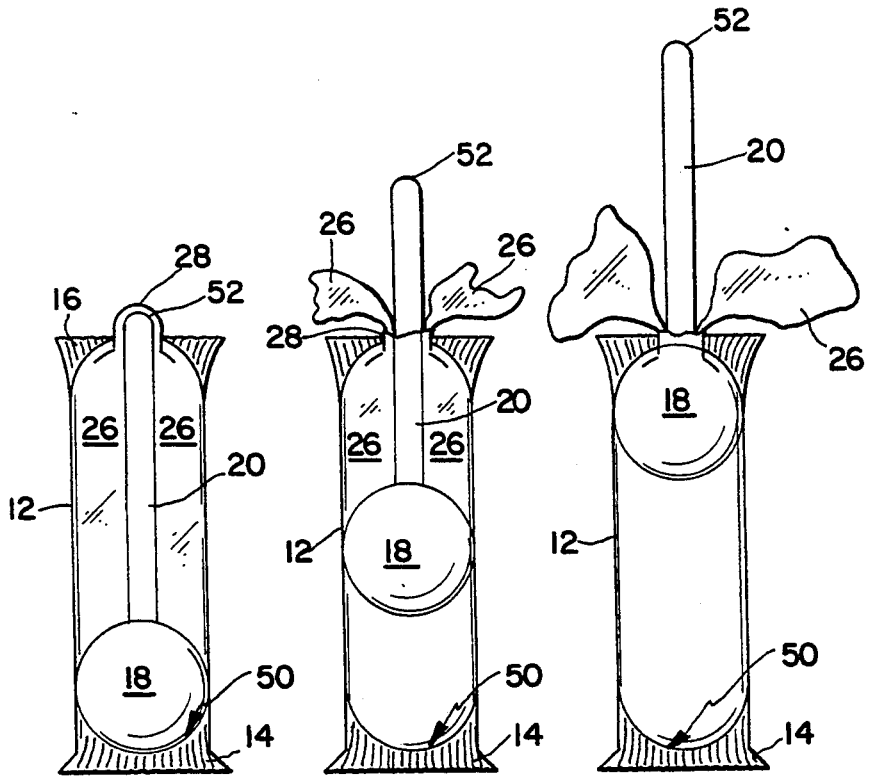
FIGS. 5A–5C are various stages of use of an alternative embodiment of the present invention.

FIGS. 5A–5C illustrate an alternative embodiment of the present invention. Turning first to FIG. 5A, spherical plunger element 18 is abutted against bottom inner wall 50 which is adjacent to crimped tubular body end 14. Crimped tubular body end 14 may have a concave spherical shape to provide complimentary mating with spherical plunger element 18. Spreader paddle 20 is connected to spherical plunger element 18; however, free end 52 may have a rounded or dome-shaped surface. Dispenser nozzle 28 receives free end 52 so that spreader paddle 20 is supported and remains centered and coaxial with the longitudinal axis of tubular body 12. In similar fashion to the preferred embodiment illustrated in FIGS. 4A–4C, FIG. 5B illustrates the piercing of free end 52 of spreader paddle 20 through dispenser nozzle 28. FIG. 5C shows complete evacuation of condiment filling 26 out of tubular body 12 with spreader paddle 20 completely protruded outside tubular body 12. Various modifications can be made to the spreader paddle and spherical plunger element. For example, this spherical plunger element may be more cylindrical in shape, may be hollow for ease of manufacture, or may have a flat lead face. Further, the spreader paddle 20 may be an elongated cylindrical tube or may have an oval cross section as opposed to the preferred knife-like flat paddle shape.

Figure 6:
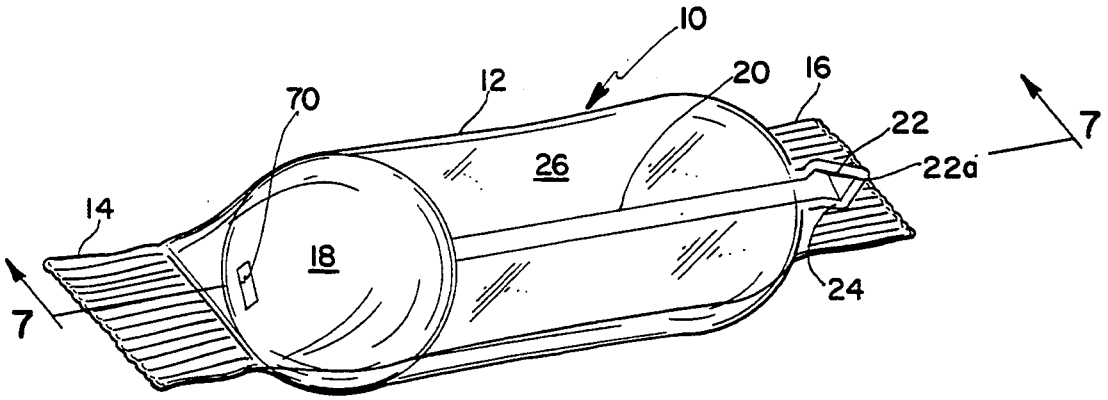
FIG. 6 is a perspective view of an alternative embodiment of a food condiment dispenser of the present invention.
Figure 7:
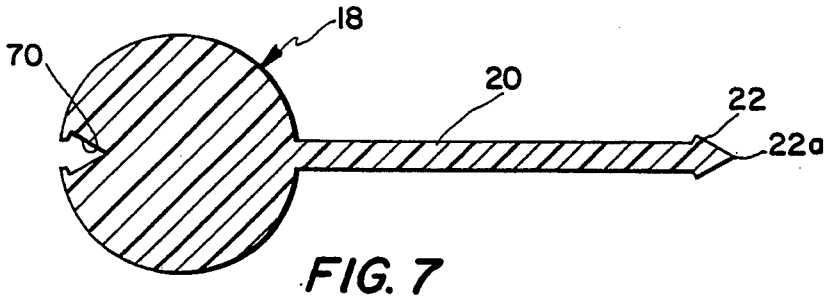
FIG. 7 is a cross-sectional view through the line 7—7 of the invention shown in FIG. 6.

FIGS. 6 and 7 show an additional embodiment of the present invention. FIG. 6 shows a perspective view of the dispenser of FIG. 1 with a notch 70 disposed in the end of spherical plunger element 18. In this embodiment, the free end 22 and pointed tip **22*a* has an arrowhead-like shape. With notch 70 provided, a series of plunger ball element and spreader paddle structures may be connected together by inserting free end 22 into notch 70** to engage the two pieces together. This snap fit permits easy connection and separation of a number of plunger ball and paddle members. Moreover, these members may be of different colors to provide an aesthetically pleasing necklace or the like, particularly for young children.

Figure 8:
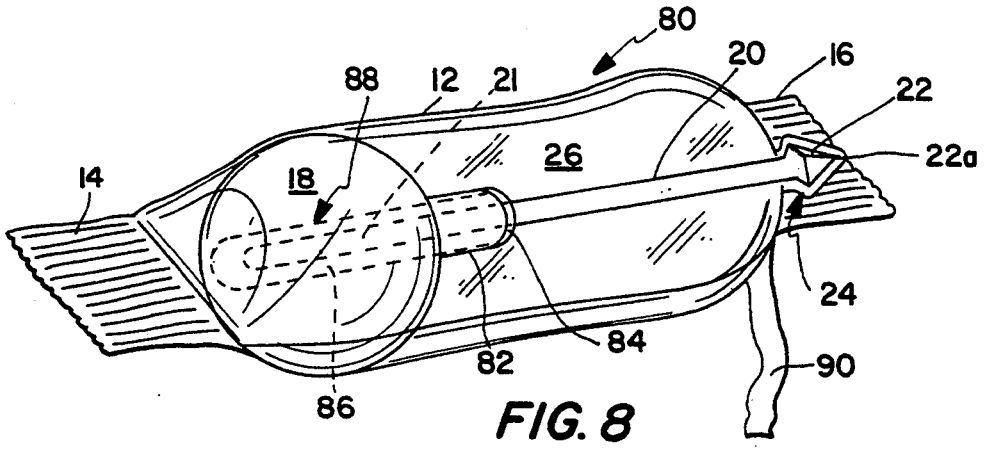
FIG. 8 is a perspective view of a liquid dispenser of an alternative embodiment of the present invention with an integrated sanitary swab.
Figure 9:
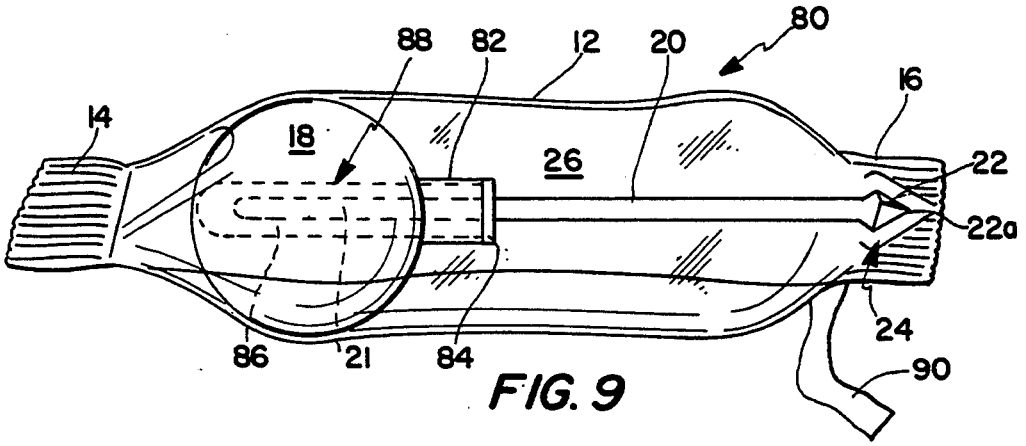
FIG. 9 is a side view of the liquid dispenser of FIG. 8.

FIGS. 8–13 show a further embodiment of the present invention. Turning first to FIG. 8, a liquid dispenser 80 is shown to include a flexible tubular body 12 with a spherical plunger element 18 and a spreader paddle 20 connected thereto. In this embodiment, spreader paddle 20 is separable from plunger element 18. Spreader paddle 20 includes an extension 21 for carrying swab 86 thereon. Swab 86 may be a sponge, cotton or any other like material. Spreader paddle 20 also carries a circumferential stop 84 for communication with plunger neck extension 82. Swab 86 carried on spreader paddle extension 21 resides within recess 88 in plunger element 18. Further, resealable or reclosable tape 90 is provided to enable the user to seal the dispenser after it has been opened.

Figure 10:
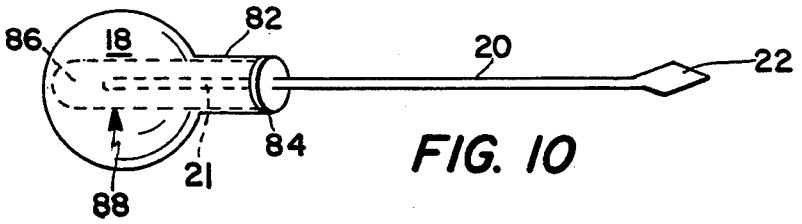
FIG. 10 is a side view of the plunger and spreader paddle arrangement of FIG. 8 with swab residing in the plunger.
Figure 11:
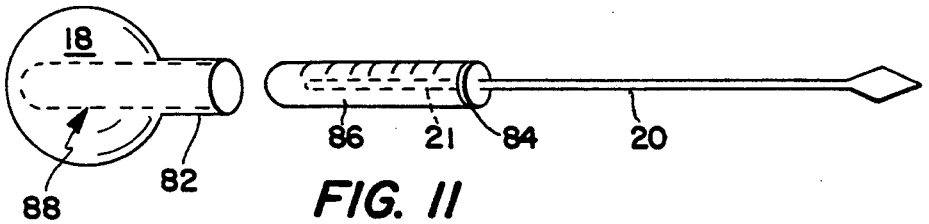
FIG. 11 is a side view of the plunger and spreader paddle arrangement of FIG. 8 with swab removed from within the plunger.

Referring now to FIGS. 10 and 11, the communication of spreader paddle 20, 21 and plunger element 18 can be seen. In FIG. 10, spreader paddle 20, 21 carries swab 86 on spreader paddle extension 21. Swab 86 is slideably insertable into recess 88 in plunger element 18. Stop 84 on spreader paddle 20 prevents swab 86 from being inserted too far into recess 88 by communicating with plunger neck 82. FIG. 11 shows spreader paddle 20, 21 completely separated from plunger element 18.

Figures 12A, 12B, 12C:
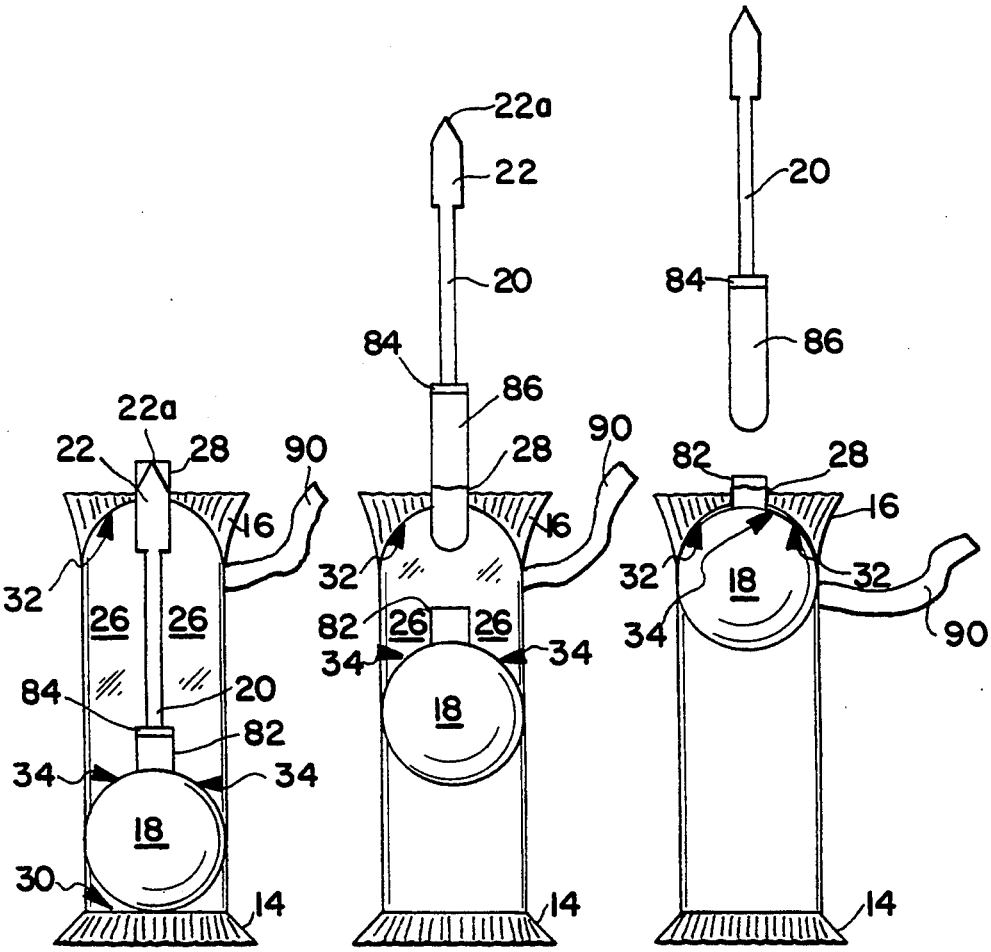
FIG. 12A is a side view of the dispenser of FIG. 8 in a full condition.
FIG. 12B is a side view of the dispenser of FIG. 8 with some of the liquid removed with swab being removed.
FIG. 12C is a side view of the dispenser of FIG. 8 with all liquid evacuated and swab removed.

FIG. 12A shows the liquid dispenser in a stored or non-dispensing state. Spherical plunger element 18 is completely retracted and abutted against bottom inner wall 30. In FIG. 12A, free end 22 of the spreader paddle 20 resides within dispenser nozzle 28 in preparation for piercing through. Stop 84 is in communication with plunger neck 82 illustrating that swab 86 is fully inserted into plunger element 18. FIG. 12B shows plunger element 18 moved toward top inner wall 32 by external manipulation of tubular body 12. As a result, pointed tip 22A on free end 22 will pierce through dispenser nozzle 28 into the environment. FIG. 12B illustrates that spreader paddle 20 can be removed from within plunger element 18 prior to the plunger element 18 being fully urged upward. This enables a user to employ swab 86 after only a portion of the liquid 26 has been evacuated. FIG. 12C illustrates the removable of swab 86 on spreader paddle 20 after all of the liquid has been evacuated from the dispenser. The exact use and timing of separation of spreader paddle 20 from plunger element 18 depends on the user's need and amount of liquid required.

Figure 13:
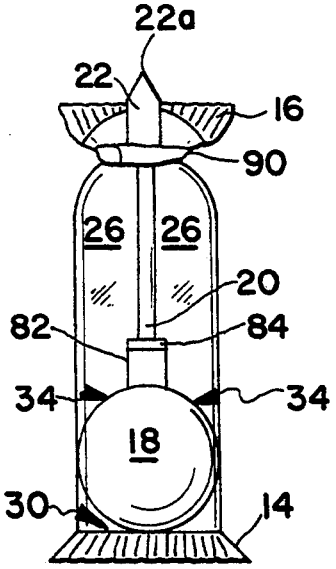

After the desired amount of liquid is evacuated from the dispenser and the spreader paddle with swab 86 is no longer needed, the swab is reinserted into recess 88 in plunger element 18 and plunger element 18 is pushed back into its original position on the bottom of the tubular body 12, as shown in FIG. 13. It can also be seen in FIG. 13 that once spreader paddle 20 and swab 86 are reinserted into plunger element 18, resealable tape 90, which is connected directly to or integral with tubular body 12, is tightly secured and wrapped around the tubular body at its top to seal and enclose spreader paddle and swab 86 therein. Adhesives on resealable tape 90 are preferred to retain the closure of tubular body 12. After tubular body 12 has been sealed, it can now be disposed of properly while decreasing the possibility of contamination and infection due to the prior exposure of spreader paddle 20 and swab 86 to a wound.

This alternative embodiment of the present invention provides an integrated sanitary swab or sponge to assist in the treatment of a wound. Such a dispenser is ideal for self-application of medicated liquids such as antibacterial salves, lotions, and the like. Further, in this embodiment, the dispensers of the present invention may be provided in pairs where one dispenser carries a cleaning liquid while the second dispenser carries the liquid medication.

It will be appreciated by those skilled in the art that various changes and modifications can be made to the illustrated embodiments without departing from the spirit of the present invention. All such modifications and changes are intended to be covered by the appended claims.

I claim:

1. A dispenser for fluids, comprising:

an elongated tubular body having first and second opposing ends; said first end being closed;

a dispensing nozzle at said second end of the tubular body;

a plunger disposed within said tubular body; said plunger having a recess therein;

an elongated spreader member connected to said plunger; said spreader member having a swab end which removably resides in said recess; and whereby said plunger, upon external manipulation of said tubular body into communication with said plunger, is movable toward said nozzle to cause ejection of fluid material out of said nozzle and ejection of said connected spreader member through said nozzle and outside said elongated tubular body into the open air for use in spreading the ejected material; said spreader member being removable from said recess upon ejection of said spreader member through said nozzle.

2. The dispenser of claim 1, wherein said elongated tubular body is manufactured of plastic.

3. The dispenser of claim 1, wherein said nozzle is an aperture created by penetration of said spreader member through said second end of the tubular body.

4. The dispenser of claim 1, wherein said plunger is spherical in shape.

5. The dispenser of claim 4, wherein said plunger has an outer diameter slightly less than the inner diameter of said tubular body.

6. The dispenser of claim 1, wherein said elongated spreader member has a first end connected to said plunger and a second end proximal to said nozzle; said spreader member being substantially parallel with the longitudinal axis of said tube.

7. The dispenser of claim 6, wherein said spreader member has an elongated paddle shape to facilitate spreading of fluid material onto a surface external to said tubular body.

8. The dispenser of claim 6, wherein said spreader member has an elongated cylinder shape to facilitate spreading of fluid material onto a surface external to said tubular body.

9. The dispenser of claim 1, wherein said second end of said tubular body includes an easily pierceable membrane for penetration by said spreader member to create said nozzle when said plunger is moved toward said second end of said tubular member upon external manipulation of said tubular body into communication with said plunger.

10. A medicated liquid dispenser, comprising:

an elongated flexible tubular body having first and second opposing ends; said first end being closed;

a dispensing nozzle at said second end of the tubular body;

a spherical plunger disposed within said tubular body; said spherical plunger having a recess therein;

an elongated spreader paddle having a first swab end removably residing in said recess and a second end disposed adjacent to said dispensing nozzle; and whereby said spherical plunger, upon external manipulation of said tubular body into communication with said plunger, is movable within the tubular body toward said second end of the tubular body urging medicated liquid out of said nozzle and causing said spreader paddle to protrude through said dispensing nozzle into the open air external to said tubular body for use in spreading the ejected medicated liquid; said swab end, upon said spreader paddle protruding through said dispensing nozzle, being capable of being removed from said recess for use external to said tubular body.

11. The medicated liquid dispenser of claim 10, wherein said tubular body contains a single portion of medicated liquid.

12. The medicated liquid dispenser of claim 10, wherein movement of said plunger, upon external manipulation of the tubular body, urges the second end of the spreader paddle to pierce the second end of the tubular body creating said dispensing nozzle.

13. The medicated liquid dispenser of claim 10, wherein said first and second ends of said tubular body have internal surfaces capable of forming a complimentary mate with the outer surface of said spherical plunger.

14. The medicated liquid dispenser of claim 10, wherein medicated liquid and said spreader paddle simultaneously exit said dispensing nozzle into the open air external to said tubular body when said spherical plunger is moved toward the second end of said tubular body.

15. The medicated liquid dispenser of claim 10, wherein said spreader paddle protruding through said dispensing nozzle is capable of spreading medicated liquid urged through said dispensing nozzle.

16. The medicated liquid dispenser of claim 10, wherein the second end of said spreader paddle has a sharpened tip.

17. The food condiment dispenser of claim 10, wherein said second end of said tubular body includes a recess for receiving the second end of said spreader paddle for supporting and centering said spreader paddle within said tubular body.

* * * * *